US010473339B2

(12) United States Patent
Song et al.

(10) Patent No.: US 10,473,339 B2
(45) Date of Patent: Nov. 12, 2019

(54) GUIDE BLADE AND AIR CONDITIONER HAVING THE SAME

(71) Applicant: Samsung Electronics Co., Ltd., Suwon-si (KR)

(72) Inventors: Woo Seog Song, Yongin-si (KR); Jong Moon Kim, Hwaseong-si (KR); Hyeong Joon Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 235 days.

(21) Appl. No.: 14/584,312

(22) Filed: Dec. 29, 2014

(65) Prior Publication Data

US 2015/0192319 A1 Jul. 9, 2015

(30) Foreign Application Priority Data

Jan. 6, 2014 (KR) ..... 10-2014-0001559

(51) Int. Cl.

| | |
|---|---|
| ***F24F 13/08*** | (2006.01) |
| ***F24F 1/0007*** | (2019.01) |
| ***F24F 1/0029*** | (2019.01) |
| ***F24F 1/0033*** | (2019.01) |
| ***F24F 1/005*** | (2019.01) |
| *F24F 13/20* | (2006.01) |

(52) U.S. Cl.

CPC ..... *F24F 1/0007* (2013.01); *F24F 1/005* (2019.02); *F24F 1/0029* (2013.01); *F24F 1/0033* (2013.01); *F24F 2013/205* (2013.01)

(58) Field of Classification Search

CPC ..... F04D 29/547; F04D 29/545; F24F 2013/205; F24F 2001/004; F24F 1/0033; F24F 1/0029; F24F 1/0007; F01D 5/141

USPC ..... 454/284, 296; 416/236, 235, 228; 415/914, 211

See application file for complete search history.

(56) References Cited

U.S. PATENT DOCUMENTS

| | | | | |
|---|---|---|---|---|
| 9,335,059 | B2 * | 5/2016 | Cho | F04D 25/082 |
| 2010/0226758 | A1 * | 9/2010 | Cookson | F04D 25/08 415/119 |
| 2014/0314575 | A1 * | 10/2014 | Cho | F04D 29/666 416/170 R |

FOREIGN PATENT DOCUMENTS

| | | | |
|---|---|---|---|
| CN | 1782594 | 6/2006 | |
| CN | 201615575 | 10/2010 | |
| CN | 202613701 | 12/2012 | |
| CN | 203375632 | 1/2014 | |
| EP | 2894345 A1 * | 7/2015 | F04D 17/04 |

(Continued)

OTHER PUBLICATIONS

Chinese Office Action dated Jul. 27, 2018 in corresponding Chinese Patent Application No. 201510004717.8.

(Continued)

*Primary Examiner* — Vivek K Shirsat
*Assistant Examiner* — Ryan L Faulkner
(74) *Attorney, Agent, or Firm* — Staas & Halsey LLP

(57) ABSTRACT

Disclosed is a plurality of guide blades configured to guide air discharged through a discharge port, and an air conditioner having the same. The guide blade includes an eddy induction groove that is concaved from at least one surface of the guide blade, and a plurality of protrusions each protruding from an inner surface of the eddy induction groove in the form of a polypyramid, to generate eddy currents of various directions, so that the guide blade may cope with air flow of various flow speeds and wind directions.

14 Claims, 4 Drawing Sheets

(56) References Cited

FOREIGN PATENT DOCUMENTS

| | | |
|---|---|---|
| KR | 1999-000953 | 1/1999 |
| KR | 1999-0048699 | 7/1999 |
| KR | 10-1271056 | 6/2013 |

OTHER PUBLICATIONS

Chinese Office Action dated Apr. 23, 2019 in Chinese Patent Application No. 201510004717.8.

* cited by examiner

GUIDE BLADE AND AIR CONDITIONER HAVING THE SAME

CROSS-REFERENCE TO RELATED APPLICATION

This application claims the benefit of Korean Patent Application No. 10-2014-0001559, filed on Jan. 6, 2014, in the Korean Intellectual Property Office, the disclosure of which is incorporated herein by reference.

BACKGROUND

1. Field

Embodiments of the present disclosure relate to a guide blade disposed on a discharge port and configured to guide air discharged through the discharge hole, and an air conditioner having the same.

2. Description of the Related Art

In general, an air conditioner is a device which adjusts indoor air by using a refrigeration cycle, in which high-temperature air of indoors is suctioned and heat-exchanged by a low-temperature refrigerant and then discharged to the indoors to cool the indoors, and on the contrary, low-temperature air of indoors is suctioned and heat-exchanged by a high-temperature refrigerant and then discharged to the indoors to heat the indoors.

The air conditioner performs the cooling or heating of indoors by the refrigeration cycle which drives a compressor, a condenser, an expansion valve and an evaporator in a forward direction or a reverse direction. The compressor provides a high temperature and high pressure gas refrigerant, and the condenser provides a normal temperature high pressure liquid refrigerant. The expansion valve decompresses the normal temperature high pressure liquid refrigerant, and the evaporator evaporates the decompressed refrigerant into a low temperature gas.

The air conditioner is classified into a separate type air conditioner in which an indoor unit and an outdoor unit are separated and installed, and an integral type air conditioner in which the indoor unit and the outdoor unit are installed together as an integral body. As for the separate type air condition, the compressor and the condenser (an outdoor heat exchanger) are provided on the outdoor unit, and the evaporator (an indoor heat exchanger) is provided on the indoor unit. Refrigerant is circulated and flowed between the outdoor unit and the indoor unit through a line connecting the indoor unit to the outdoor unit.

A discharge port is provided on a front surface of the indoor unit such that air having exchanged heat with the refrigerant is discharged through the discharge port.

SUMMARY

Therefore, it is an aspect of the present disclosure to provide a guide blade configured to cope with air flow of various flow speeds and wind directions, and an air conditioner having the same.

Additional aspects of embodiments will be set forth in part in the description which follows and, in part, will be obvious from the description, or may be learned by practice of the invention.

In accordance with one aspect of an embodiment, an air conditioner includes a housing, a plurality of guide blades, an eddy induction groove and a plurality of protrusions. The housing may be provided with a discharge port. The plurality of guide blades may be disposed on the discharge port and configured to guide air discharged through the discharge port. Each of the plurality of guide blades includes an eddy induction groove that is concavely formed to generate eddy currents, and a plurality of protrusions each protruding from an inner surface of the eddy induction groove in the form of a polypyramid.

A virtual surface connecting vertexes of the plurality of protrusions may be provided in a streamline shape.

The eddy induction groove may have a depth equal to or smaller than 70% of a thickness of the guide blade.

The eddy induction groove may be formed at a portion of an upstream side in an air flow direction of the guide blade.

The eddy induction groove may be formed on at least one of both surfaces of the guide blade.

An edge of the polypyramid protrusion may form an angle of 80 degree of less with respect to a virtual line extending from the vertex in a normal direction of the virtual surface.

The discharge port may be provided at a front surface of the housing in the form of a circular ring; and the plurality of guide blades each extends in a radial direction of the discharge port and disposed while being spaced apart from each other in a circumferential direction of the discharge port.

In accordance with one aspect of an embodiment, a guide blade configured to guide air flow includes an eddy induction groove and a plurality of protrusions. The eddy induction groove may be concaved from at least one surface of the guide blade. The plurality of protrusions may each protrude from an inner surface of the eddy induction groove in the form of a polypyramid.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
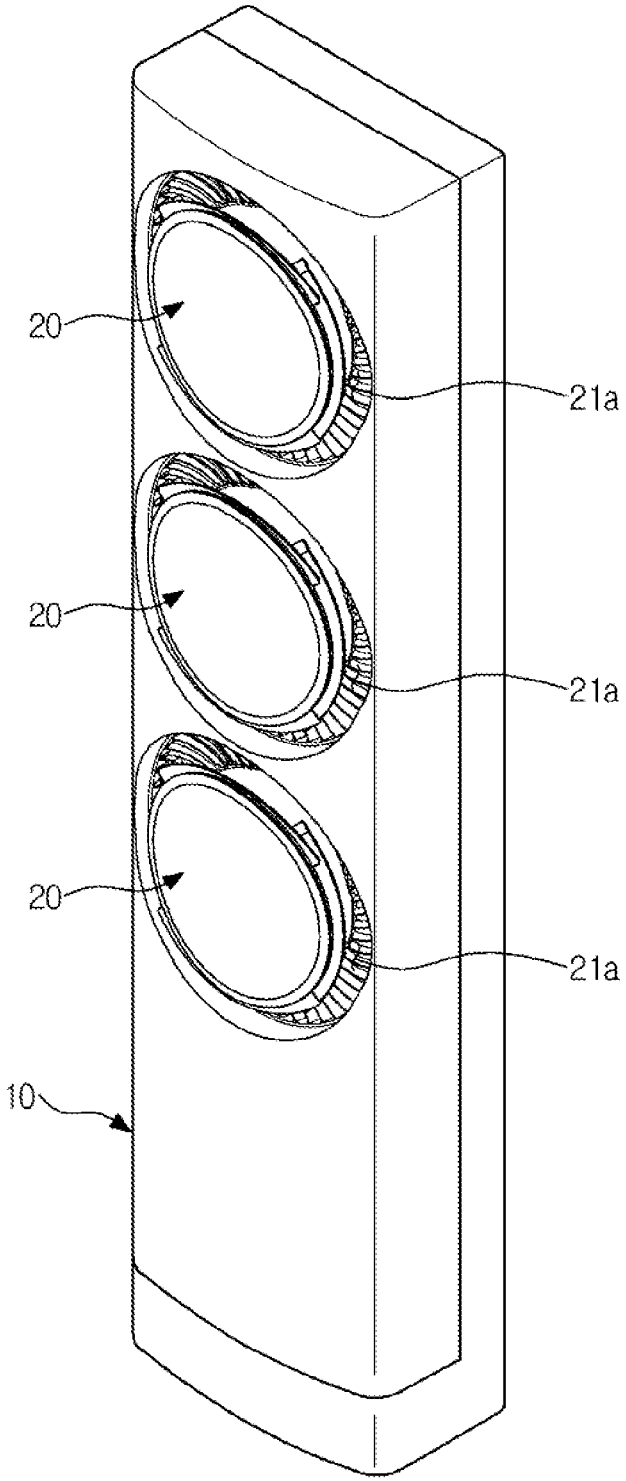
FIG. 1 is a perspective view illustrating an indoor unit of an air conditioner according to an embodiment of the present disclosure.

Reference will now be made in detail to the embodiments of the present disclosure, examples of which are illustrated in the accompanying drawings, wherein like reference numerals refer to like elements throughout.

Figure 2:
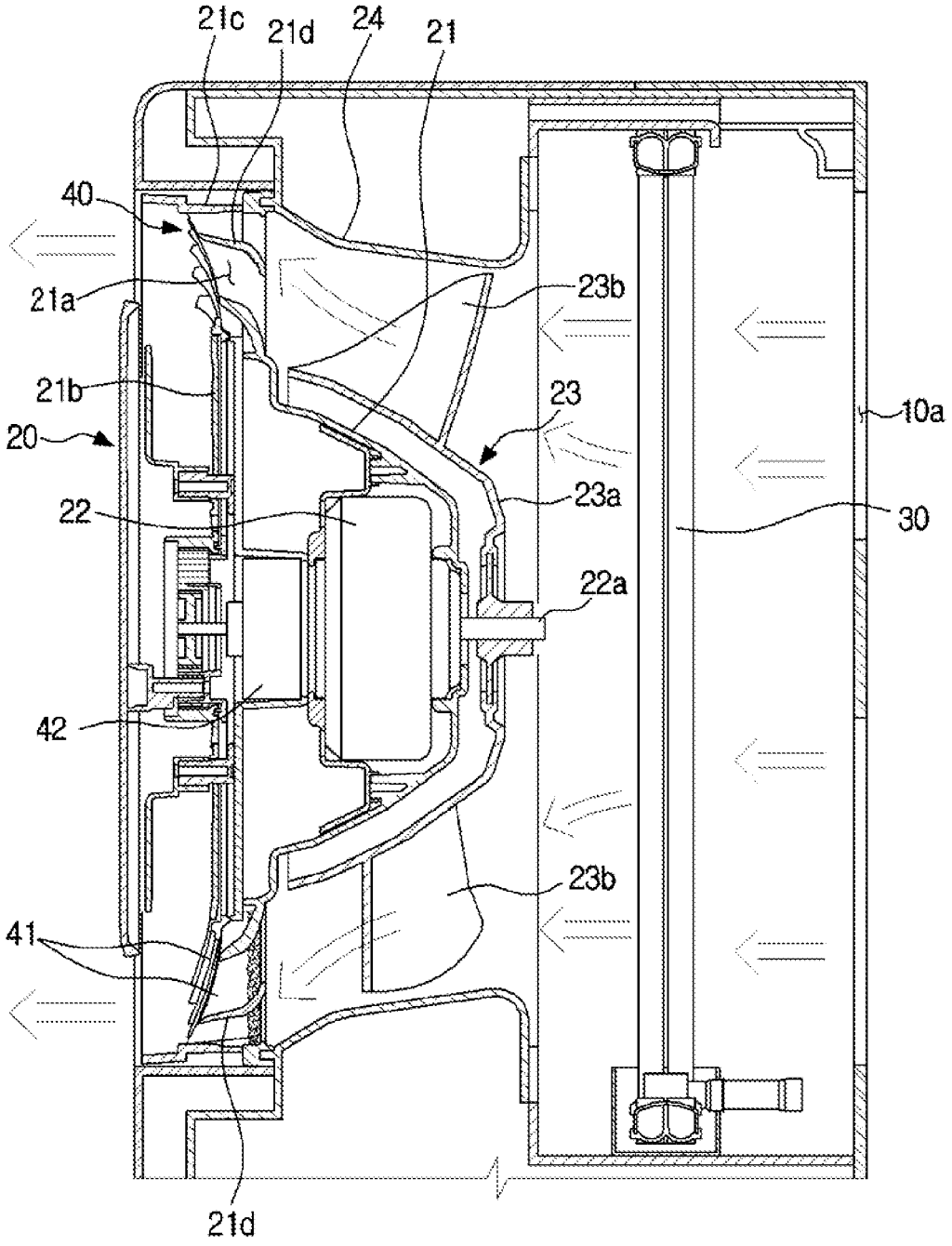
FIG. 2 is a partial cross sectional view illustrating an indoor unit of an air conditioner according to an embodiment of the present disclosure.

Referring to FIGS. 1 and 2, an indoor unit of an air conditioner includes, for example, a housing 10 forming an external appearance thereof, a plurality of mixed flow fan units 20 disposed in the housing 10 and generating suction force and blowing force such that indoor air is suctioned into the housing 10 and then discharged to the indoor again, a heat exchanger 30 disposed in the housing 10 while being spaced apart from the mixed flow fan units 20 at a rear of the mixed flow fan units 20, and a discharge port opening/closing apparatus 40 to open and close a discharge port, which will be described later.

The housing 10 may be provided, for example, with three mixed flow fan units 20 disposed in an upper side and lower side direction. A suction port 10*a* suctioning air may be provided at a rear side of the housing 10, and a discharge port 21*a* discharging air may be provided at a front surface of the housing 10. The discharge port 21*a* according to an embodiment of the present disclosure may be provided at each of the mixed flow fan units 20, so that a total of, for example, three of the discharge ports 21*a* is provided in an upper side and lower side direction.

The mixed flow fan unit 20 may include a diffuser 21 forming the discharge port 21*a*, a fan motor 22 installed at a rear side of the diffuser 21, a mixed flow fan 23 coupled to a shaft of the fan motor 22 and rotated by the fan motor 22, and a duct 24 coupled to the rear surface of the diffuser 21 to form a moving passage of air during discharge of the air introduced by the mixed flow fan 23 into the discharge port 21*a*.

The diffuser 21 may be disposed, for example, at a front of the mixed flow fan 23, and may include, for example, a disk part 21*b* provided in a circular shape and in which the fan motor 22 is installed, a ring shaped part 21*c* provided in a circular ring shape and disposed outside of the disk part 21*b* while being spaced apart from the disk part 21*b* to form the above described discharge port 21*a* between the disk part 21*b* and the ring shaped part 21*c*, and a plurality of guide blades 21*d* each having one end connected to the disk part 21*b* and the other end connected to the ring shaped part 21*c* to adjust wind directions of air discharged through the discharge port 21*a*.

The fan motor 22 may be installed, for example, on the rear surface of the disk part 21*b*, and the rotation shaft 22*a* of the fan motor 22 on which the mixed flow fan 23 is installed may be disposed to face a rear side.

The mixed flow fan 23 may be disposed between the diffuser 21 and the heat exchanger 30, to suction air from the heat exchanger 30 and discharge the air through the discharge port 21*a*. The mixed flow fan 23 may include, for example, a hub 23*a* coupled to the rotation shaft 22*a* of the fan motor 22, and a plurality of fan blades 23*b* extending from an outer circumferential surface of the hub 23*a*. An outer diameter of the hub 23*a* may be decreased as being directed rearward such that air discharged through the discharge port 21*a* is radially and outwardly discharged in an oblique manner.

The duct 24 may be formed while surrounding the mixed flow fan 23 to guide the air discharged from the mixed flow fan 23 toward the discharge port 21*a*.

The heat exchanger 30 may be disposed between the mixed flow fan unit 20 and the suction port 10*a*, and, suctions heat from air introduced through the suction port 10*a* or discharge heat while performing heat exchange with the air.

As described above, the discharge port 21*a*, which may be provided between the disk part 21*b* and the ring shaped part 21*c*, may be provided in a circular ring shape.

The guide blades 21*d* radially and obliquely extend to guide air discharged through the discharge port 21*a*, and may be, for example, connected to the disk part 21*b* at an inner side end thereof and connected to the ring shaped part 21*c* at an outer side end thereof. In addition, the guide blades 21*d* may be, for example, disposed while being spaced apart from each other in a circumferential direction such that air discharged from the mixed flow fan through between the guide blades 21*d* is discharged by being guided by the plurality of guide blades 21*d*.

The discharge port opening/closing apparatus 40 may include, for example, a plurality of opening/closing members 41 installed at the discharge port so as to move in a radial direction, and an opening/closing motor 42 allowing the opening/closing members 41 to move, by generating a rotary force.

Figure 3:
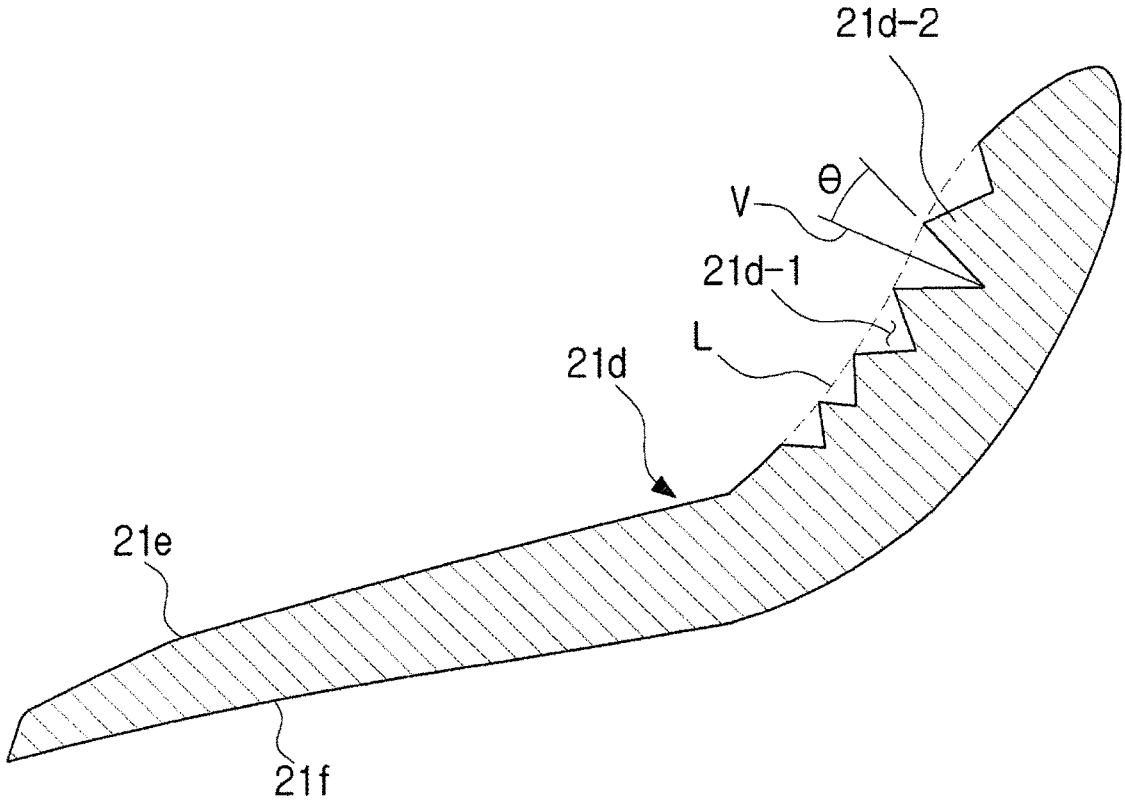
FIG. 3 is a perspective view illustrating a guide blade provided on an indoor unit of an air conditioner according to an embodiment of the present disclosure.
Figure 4:
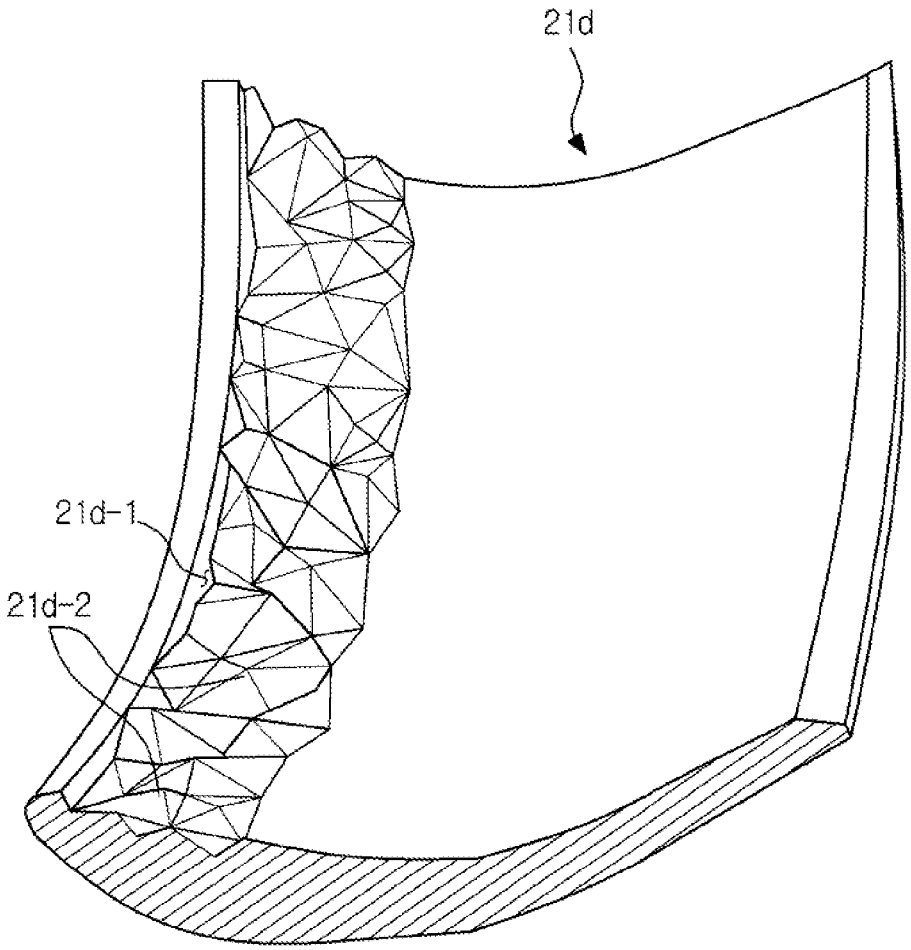
FIG. 4 is a cross sectional view illustrating a guide blade provided on an indoor unit of an air conditioner according to an embodiment of the present disclosure.

Referring to FIGS. 3 and 4, one surface of each of the guide blades 21*d* may include an eddy induction groove 21*d*-1 generating eddy currents and a plurality of protrusions 21*d*-2 protruding in the form of, for example, a polygonal shape from an inner surface of the eddy induction groove 21*d*-1. According to the this embodiment, the eddy induction groove 21*d*-1 and the plurality of protrusions 21*d*-2 are formed on one surface of the guide blade 21*d*, and in detail, on a portion of an upper stream side in an air flow direction. Specifically, the guide blade 21*d* has a first guide blade surface 21*e* and a second guide blade surface 21*f*, and the eddy induction groove 21*d*-1 and the plurality of protrusions 21*d*-2 are formed on the first guide blade surface 21*e*.

The eddy induction groove 21*d*-1 allows a portion of the air discharged through between the guide blades 21*d* to be introduced thereinto, thereby generating eddy currents. The eddy currents generated in the eddy induction groove 21*d*-1 prevent flow separation from occurring, and thus air may smoothly pass through between the guide blades 21*d*, so that the noise is reduced and the flow speed of air is increased due to the eddy induction groove 21*d*-1.

The eddy induction groove 21*d*-1 according to the embodiment of the present disclosure may have, for example, a depth equal to or smaller than 70% of a thickness of the guide blade 21*d*, which prevents the strength of the guide blade 21*d* from being decreased below a predetermined level due to the forming of the eddy induction groove 21*d*-1.

As described above, the plurality of protrusions 21*d*-2 may each be provided in the form of, for example, a polypyramid such that air introduced into the eddy induction groove 21*d*-1 collides with edges of the protrusions 21*d*-2 and diffuses to change the flow direction thereof, and collides with surfaces of the protrusions 21*d*-2, to generate eddy currents.

Accordingly, eddy currents of various directions exit in the eddy induction groove 21*d*-1. The eddy currents of various directions allow the reduction of noise and the increase in the flow speed of air to be maintained even if air discharged by passing through between the guide blades 21*d* is varied at the wind speeds and directions.

According to an embodiment, a virtual surface L connecting vertices of the plurality of protrusions 21*d*-2 may be provided in a streamline shape, to prevent flow of air passing through between the guide blades 21*d* from being interfered by the protrusions 21*d*-2.

In addition, the edge of the protrusion 21*d*-2 provided in a polypyramid shape forms, for example, an angle θ of 80 degree or less with respect to a virtual line V extending from the vertex in a normal direction of the virtual surface, to effectively form the eddies. That is, if the angle θ exceeds 80 degrees, eddies may not be generated.

Although the eddy induction groove 21*d*-1 and the plurality of protrusions 21*d*-2 according to an embodiment may be formed on one surface of the guide blade 21*d*, the present disclosure is not limited thereto. For example, the eddy induction groove 21*d*-1 and the plurality of protrusions 21*d*-2 according to another embodiment may be formed on both surfaces of the guide blade 21*d*.

Although the eddy induction groove 21*d*-1 and the plurality of protrusions 21*d*-2 according to an embodiment are formed at a portion of an upstream side in the air flow direction, the present disclosure is not limited thereto. For example, the eddy induction groove 21*d*-1 and the plurality of protrusions 21*d*-2 according to another embodiment may be formed at the entire area or at a portion of a downstream side of the air flow direction depending on designs.

As is apparent from the above, eddy currents of various directions are generated by, for example, polypyramid shaped protrusions in an eddy induction groove, so that the guide blade can cope with air flow of various flow speeds and wind directions.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a housing having a discharge port disposed at a front surface of the housing;

a fan having a plurality of fan blades to discharge air through the discharge port; and a plurality of guide blades which extend in a radial direction of the discharge port and configured to guide the air discharged from the fan and passing through the discharge port, each of the plurality of guide blades including:

a plurality of eddy induction grooves that are concavely formed on at least one surface of a respective guide blade to generate eddy currents, and a plurality of protrusions, each of the plurality of protrusions formed in a pyramid shape that protrudes from inner surfaces of respective eddy induction grooves with edges of the plurality of protrusions forming a polypyramid structure.

2. The air conditioner of claim 1, wherein a virtual surface connects vertices of the plurality of protrusions, and the virtual surface is provided in a streamline shape to thereby prevent the air discharged through the discharge port from being interfered with by the plurality of protrusions.

3. The air conditioner of claim 1, wherein at least one of the respective eddy induction grooves has a depth equal to or smaller than 70% of a thickness of the respective guide blade.

4. The air conditioner of claim 1, wherein, for each respective guide blade of the plurality of guide blades, an eddy induction groove of the respective guide blade is formed at a portion of an upstream side in an air flow direction of the respective guide blade.

5. The air conditioner of claim 1, wherein each respective guide blade of the plurality of guide blades includes a first blade surface and a second blade surface opposite the first blade surface, and eddy induction grooves of the respective guide blade is formed on at least one of the first blade surface and the second blade surface of the respective guide blade.

6. The air conditioner of claim 1, wherein a virtual surface connects vertices of the plurality of protrusions, a virtual line extends from a vertex at a base of a respective protrusion, of the plurality of protrusions, in a normal direction with respect to the virtual surface, and an edge of the respective protrusion forms an angle of 80 degree or less with respect to the virtual line.

7. The air conditioner of claim 1, wherein:

the discharge port is in the form of a circular ring; and the plurality of guide blades which extend in the radial direction of the discharge port, and are spaced apart from each other in a circumferential direction of the discharge port.

8. A guide blade disposed on a downstream side of a fan having a plurality of fan blades and configured to guide air discharged from the fan, the guide blade comprising:

a plurality of eddy induction grooves that are concaved from at least one surface of the guide blade to generate eddy currents, the guide blade formed to extend in a radial direction of a discharge port; and a plurality of protrusions, each of the plurality of protrusions formed in a pyramid shape that protrudes from inner surfaces of respective eddy induction grooves with edges of the plurality of protrusions forming a polypyramid structure.

9. The guide blade of claim 8, wherein a virtual surface connects vertices of the plurality of protrusions and each end of the eddy induction groove, and the virtual surface is provided in a streamline shape to thereby prevent the air flow from being interfered with by the plurality of protrusions.

10. The guide blade of claim 8, wherein the eddy induction groove has a depth equal to or smaller than 70% of a thickness of the guide blade.

11. The guide blade of claim 8, wherein the eddy induction groove is formed at a portion of an upstream side in an air flow direction of the guide blade.

12. The guide blade of claim 8, wherein the guide blade includes a first blade surface and a second blade surface opposite the first blade surface, and the eddy induction groove is formed on at least one of the first and second blade surfaces.

13. The guide blade of claim 8, wherein a virtual surface connects vertices of the plurality of protrusions, a virtual line extends from a vertex at a base of a respective protrusion, of the plurality of protrusions, in a normal direction with respect to the virtual surface, and an edge of the respective protrusion forms an angle of 80 degree or less with respect to the virtual line.

14. An air conditioner comprising:

a discharge port;

a fan having a plurality of fan blades to discharge air through the discharge port; and a plurality of guide blades which extend in a radial direction of the discharge port and configured to guide the air discharged from the fan and passing through the discharge port, each of the plurality of guide blades including:

a plurality of eddy induction grooves formed so that a portion of the air to be discharged is introduced into the plurality of eddy induction grooves, respectively, before the portion of the air is discharged out of the discharge port, and protrusions that each have a pyramid shape that protrude from inner surfaces of respective eddy induction grooves with edges of the protrusions forming a polypyramid structure to have the air introduced into the plurality of eddy induction grooves collides with the edges of the protrusions and thereby diffuses to change flow direction and thereby collide with surfaces of the protrusions, wherein the plurality of eddy induction grooves and the protrusions generate eddy currents in the air to be discharged through the discharge port.

* * * * *